US006089348A

United States Patent [19]

Bokor

[11] Patent Number: 6,089,348

[45] Date of Patent: Jul. 18, 2000

[54] BLOWER NOISE SILENCER

[75] Inventor: Ken Bokor, Blenheim, Canada

[73] Assignee: Bokor Manufacturing Inc., Blenheim, Canada

[21] Appl. No.: 09/401,523

[22] Filed: Sep. 22, 1999

[51] Int. Cl.[7] ..... F01N 1/08

[52] U.S. Cl. ..... 181/272; 181/255; 181/256; 181/279

[58] Field of Search ..... 181/229, 255, 181/252, 256, 269, 272, 279, 280

[56] References Cited

U.S. PATENT DOCUMENTS 3,235,003 2/1966 Smith ..... 181/256

4,116,303 9/1978 Trudell ..... 181/252

*Primary Examiner*—Khanh Dang

[57] ABSTRACT

A blower noise silencer comprises both an air turbulence stage and a noise absorption stage. The air turbulence stage includes a tubular screen enclosing a spiral vane wrapping around a central bore running through the air turbulence stage. The screen is surrounded by a hollow chamber. The noise absorption stage includes a hollow tubular screen surrounded by a chamber packed with sound dampening material. Each chamber in the silencer is closed other than through the screen that it surrounds whereas the screens open at one another and to opposite ends of the silencer to provide air flow movement into and out of the silencer.

2 Claims, 5 Drawing Sheets

BLOWER NOISE SILENCER

FIELD OF THE INVENTION

The present invention relates to a device for silencing blower noise.

BACKGROUND OF THE INVENTION

A typical silencer, i.e. noise reducing muffler is one which has a central air flow corridor surrounded by a chamber packed with sound dampening material.

Although this known type of muffler is relatively efficient, attempts have been made to make it more efficient. For example, mufflers have been developed with baffles within the central air flow region surrounded by the packing material. These baffles, while effective from a sound diminishing standpoint, adversely affect the performance of the blower because of the back pressure that they provide against the air output from the blower.

SUMMARY OF THE PRESENT INVENTION

The present invention provides a two stage silencer which is substantially more efficient in reducing blower noise than the single stage muffler or silencer described above.

More particularly, the blower noise silencer of the present invention comprises both an air turbulence stage and a noise absorption stage.

The air turbulence stage includes a tubular screen enclosing a spiral vane which wraps around a central bore running the length of the air turbulence stage. The screen is surrounded by a hollow chamber.

The noise absorption stage includes a hollow tubular screen surrounded by a chamber packed with sound dampening material.

Each chamber is closed, other than through the screen that it surrounds. The screens open at one another and to opposite ends of the silencer to provide air flow movement into and out of the silencer. Due to the porous nature of the screens they also allow air movement into and out of the chambers of the silencer.

The incorporation of the two separate stages cooperating with one another in the silencer makes each stage more efficient than it would be if it were used on its own.

BRIEF DESCRIPTION OF THE DRAWINGS

The above as well as other advantages and features of the present invention will be described in greater detail according to the preferred embodiments of the present invention in which.

DETAILED DESCRIPTION ACCORDING TO THE PREFERRED EMBODIMENTS OF THE PRESENT INVENTION

Figure 1:
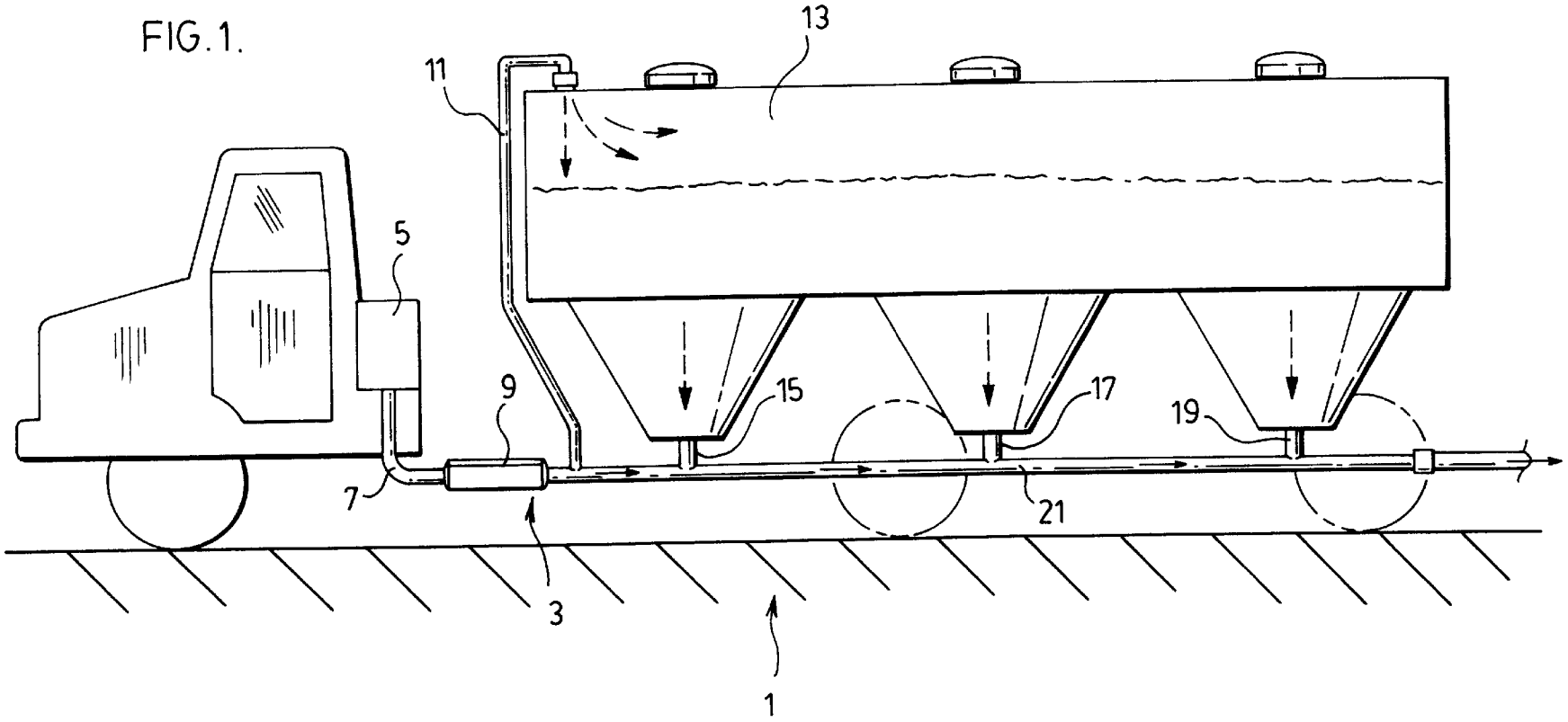
FIG. 1 is a side view of truck having a blower operated pneumatic conveying system fitted with a silencer according to the present invention.

FIG. 1 shows a truck generally indicated at 1 which includes a pneumatic conveying system generally indicated at 3. This conveying system comprises a motor operated blower 5 which outputs to an air line 7. As a result of pressure at both the intake and the output of the blower the air within the system vibrates creating high decibel noise levels. As the pressure increases so do the noise levels.

Line 7 feeds to silencer 9 which is the subject of the present invention and which allows the air after noise attenuation by the silencer to feed to a further pair of air lines 11 and 21. Line 11 as shown in FIG. 1 feeds directly into a product containing tank 13 of the truck. The pressure applied by this air causes the product in the tank to feed down through a plurality of outlets 15, 17 and 19 to a second air line 21 also fed from blower 5. The air passing along line 21 carries the product to any desired destination.

Figure 2:
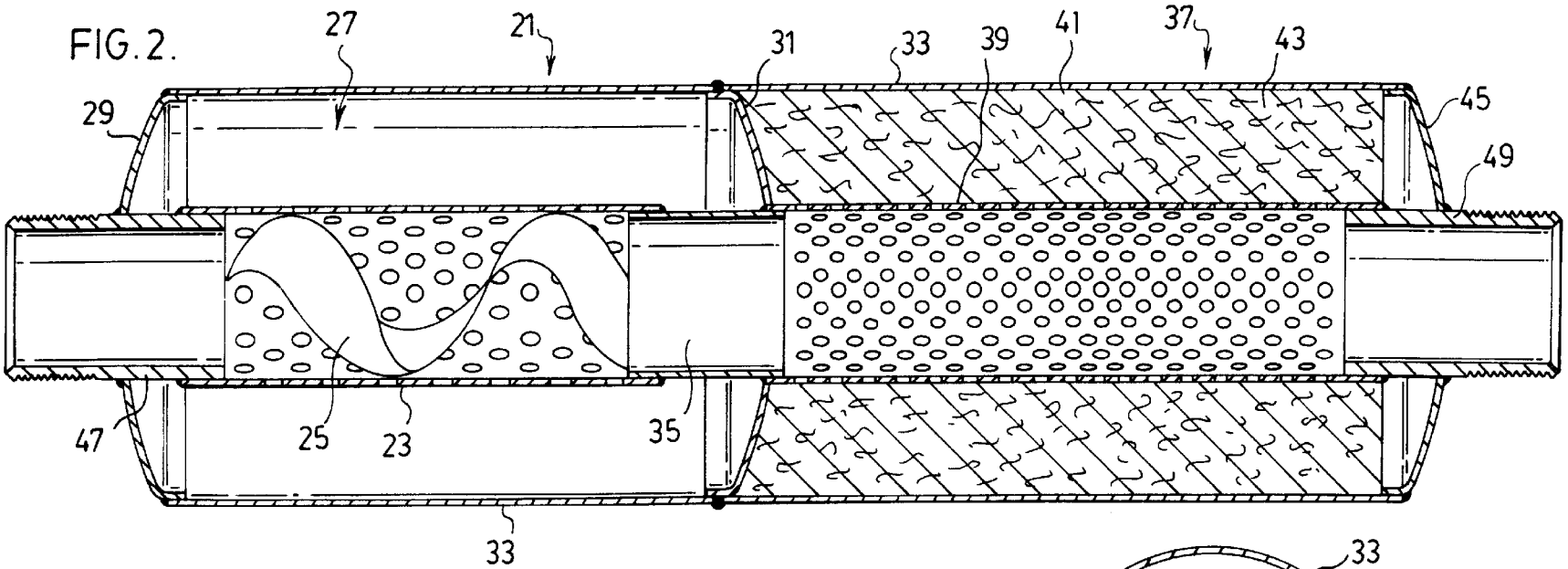
FIG. 2 is a longitudinal sectional view of the silencer from the pneumatic conveying system of FIG. 1.
Figure 3:
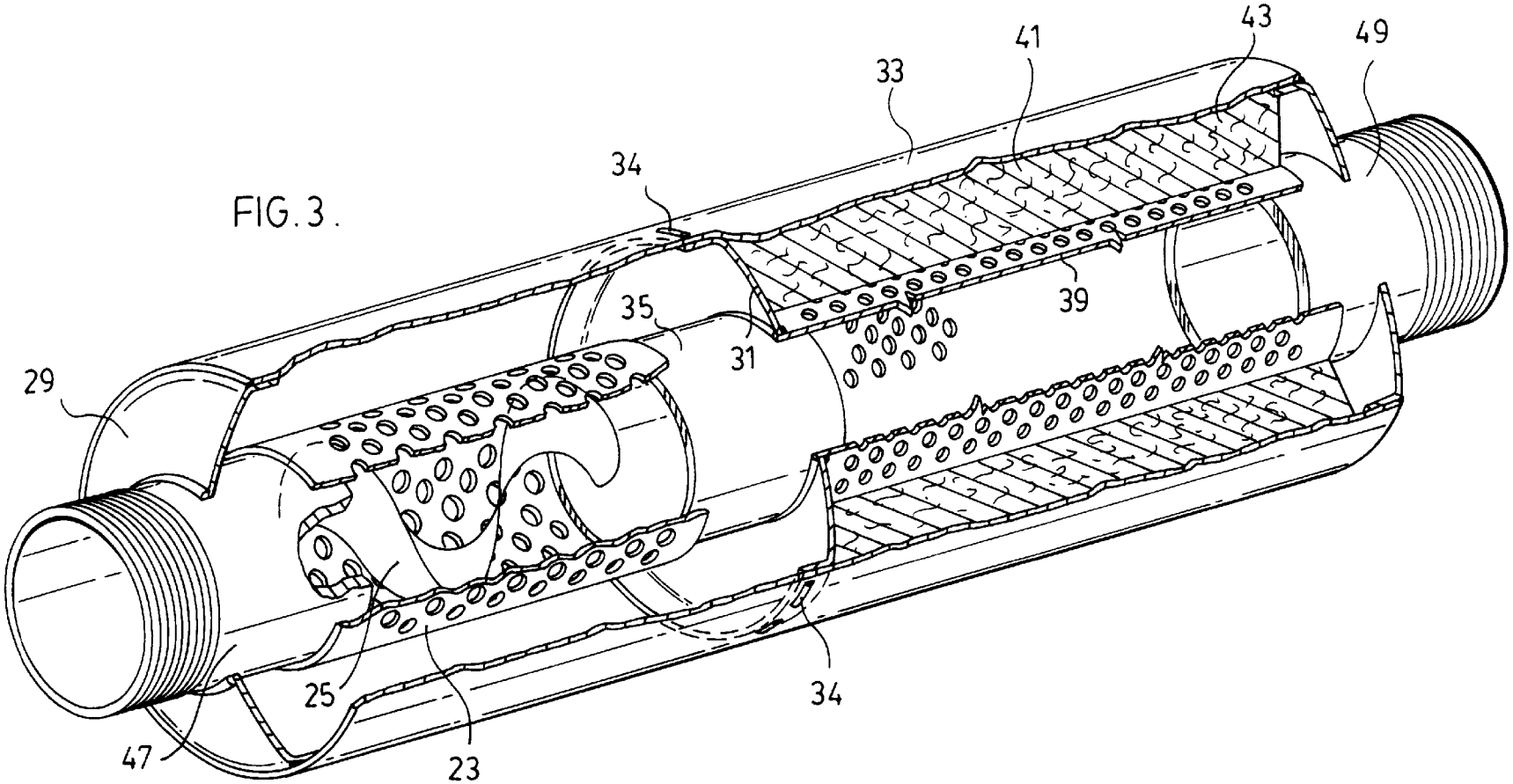
FIG. 3 is a partially sectioned perspective view of the silencer of FIG. 2.

The truck set up described above is only one example of how the silencer of the present invention can be used. For example, the silencer could be used at the intake rather than the output end of the blower, at both ends of the blower or used with a completely different type of blower or other motor operated device outputting noise carrying exhaust air. Regardless of its use, the silencer provides a very effective noise dampening on the air passing through it as a result of its construction as best shown in FIGS. 2 and 3 of the drawings.

More particularly, silencer 9 has an air turbulence stage generally indicated at 21 and a sound absorption stage generally indicated at 37. These two stages cooperate with one another to substantially noise dampen the air passing through the silencer with little adverse effect on performance of blower 9.

Figure 2A:
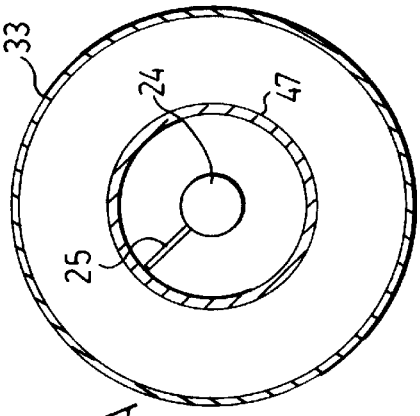
FIG. 2A is an end view of the silencer shown in FIG. 2.

Air turbulence stage 21 comprises a central corridor defined by a tubular screen 23. A spiral vane 25 is contained within screen 23. The vane wraps around an air flow bore 24 as best seen in FIG. 2A of the drawings.

Screen 23 is surrounded by a hollow tubular chamber 27.

The noise absorption stage 37 of the silencer, once again comprises a central corridor defined by a tubular screen 39. In this case, the screen is hollow, i.e. internally free of any air flow impediments.

Screen 39 is surrounded by a chamber 41 which is filled with noise dampening material 43. This noise dampening material may for example be in the form of fiberglass packing or other similar materials as are known in the art to have noise attenuation properties.

The external construction of silencer 9 is both simple and efficient. The outer end of stage 21 is closed off by a dome shaped cap 29 with a similar cap 45 being provided at the outer end of stage 37. Provided internally of the silencer is a further dome shaped member 31 turned in the opposite direction to member 29.

As will be clearly seen in FIG. 2 of the drawings, member 31 forms a blocking element between chambers 27 and 41 of the two stages 21 and 37 respectively.

A solid wall tubular connector 35 fits centrally through the washer-like blocking member 31 to connect the two tubular screens 23 and 39 in-line with one another along the silencer. To complete the silencer construction, a pair of solid wall tubular threaded members 47 and 49 are provided to its opposite ends again in-line with the connected tubular screens 23 and 39 to form a continuous path throughout the muffler.

All of the members 29, 31 and 45 are welded internally of an exterior side wall 33 extending the full length of the silencer. In order to achieve this welding at the center member 31 the side wall is provided with circumferentially spaced cut outs 34. These cut outs align with the short flange on member 31 and therefore, provide access to the welding of this member within the silencer. The other members 29 and 45 are accessible for welding through the opposite ends of the silencer.

From an economics of construction standpoint, it will be seen that members 29, 31 and 45 are all identical and therefore interchangeable with one another in the building of the silencer.

Silencer 9 can be installed with either of the two stages facing the blower at either the intake or the output side of the blower. Regardless of its direction of installation, the silencer is effective in dampening the sound produced by the blower.

In air turbulence stage 21 some of the air fed along the central air flow corridor impacts spiral vane 25 and is thrown into chamber 27 by the outwardly angled vane. Some of the air also continues through bore 24. The air, as it is thrown out into hollow chamber 27, is set up into multiple air flow patterns within chamber 27. These multiple air flow patterns which vibrate at different frequencies are then forced back into the center air passage to continue through the silencer. Here they impact with the air moving through bore 24 which is vibrating at still a different frequency.

The end result of the mixing of all of the different frequency air flows is that they tend to cancel or neutralize one another making for a more homogeneous smoother air flow out of the air turbulence stage. This air flow with much of the vibration eliminated therefrom produces substantially less noise than it does entering the air turbulence stage of the silencer.

As a result of the noise attenuation provided by air turbulence stage 21 described immediately above, there is substantially less demand placed on the sound absorption stage of the silencer because it does not have to take out the high vibration noise removed by the air turbulence stage. This remains the case regardless of the direction of installation of the silencer.

As will be clearly seen from the construction of the silencer shown in FIGS. 2 and 3, the air is not allowed to transfer directly from one chamber to the other because of blocking member 31. Therefore all of the air is funneled back to the central corridor from both chambers in order to pass completely through the silencer making sure that each chamber produces its desired effect on the air.

One particularly desirable feature of the silencer is the relatively small amount of back pressure that it places on the blower. This back pressure can be varied to match optimum performance of the blower by varying the size of bore 24 through the air turbulence chamber.

As seen in FIG. 3 the holes in screen 23 of the air turbulence stage are larger than the holes in screen 39 moves more easily through screen 23 for enhanced turbulence whereas the air, once moved into chamber 41 stays trapped in the packing material for a longer duration. In addition, the smaller openings in screen 39 help to keep the packing material itself in place within chamber 41.

Figure 4:
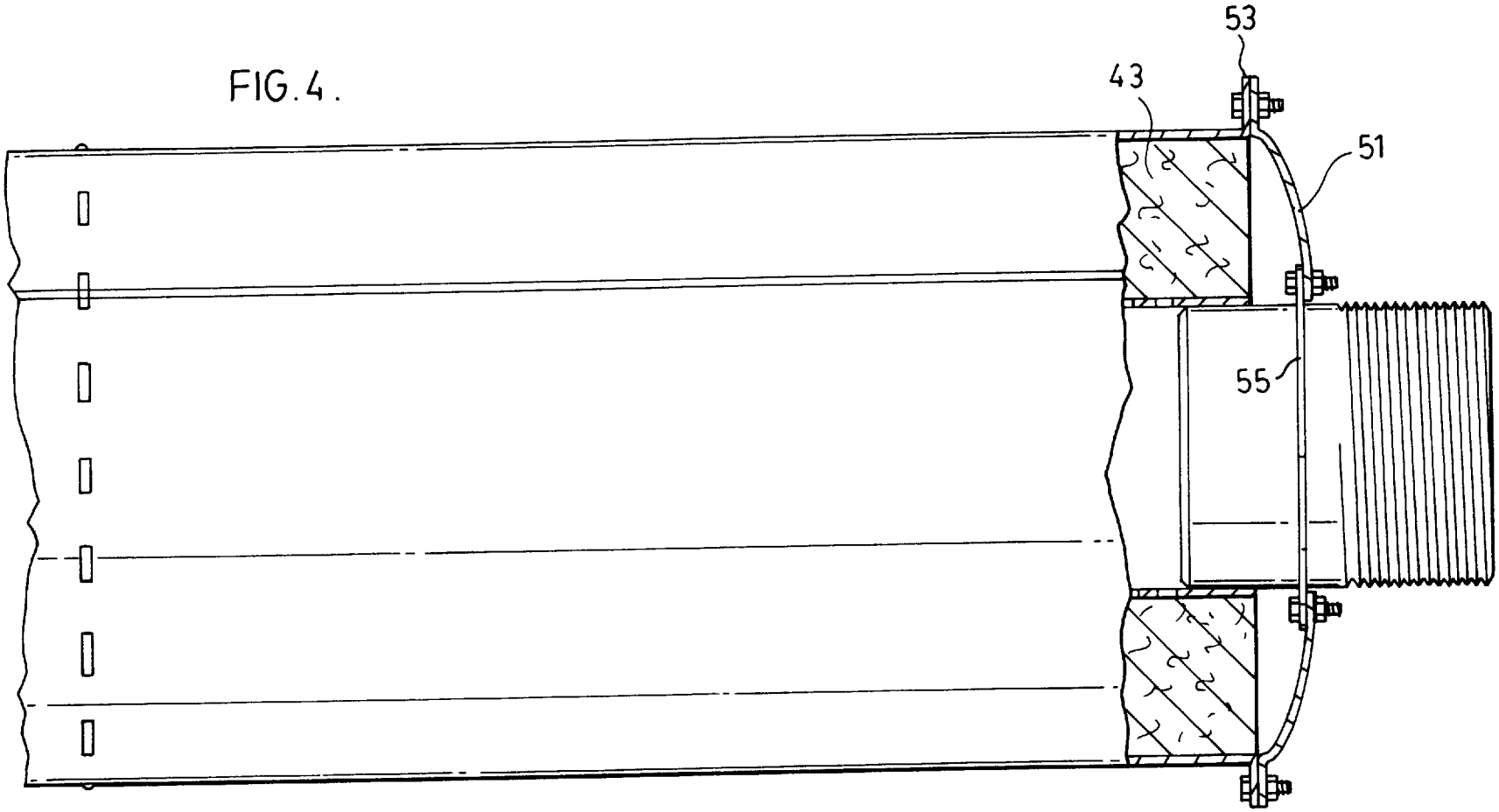
FIG. 4 is an enlarged side view showing, in partial section, the noise absorbing stage of a silencer according to another preferred embodiment of the invention.
Figure 5:
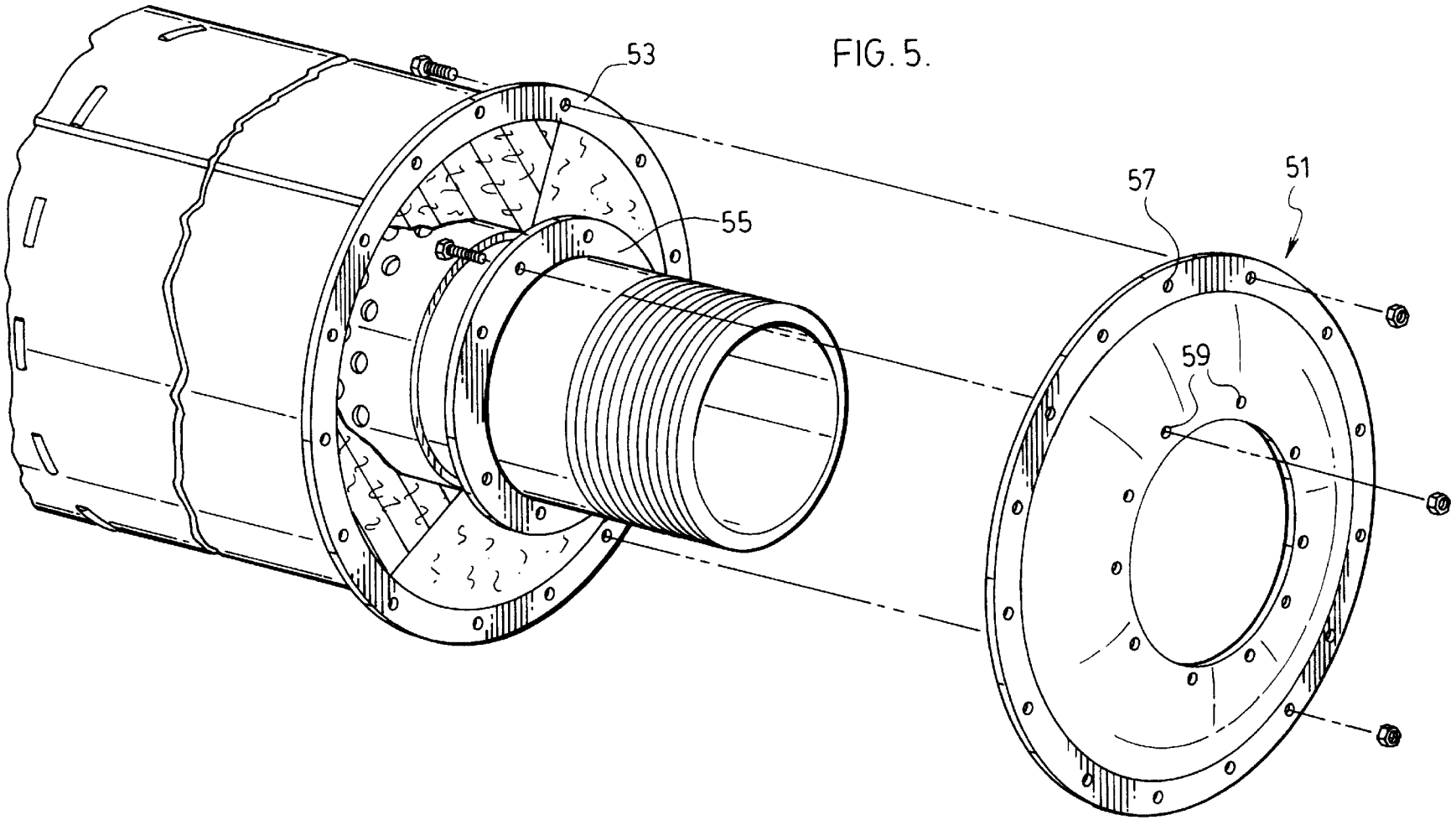
FIG. 5 is an exploded perspective view of the silencer shown in FIG. 4.

FIGS. 4 and 5 of the drawings show a slight modification to the silencer in which the exterior end of the packed end of the silencer is provided with a removable end cap 51. The main external body portion of the silencer includes a first flange 53 with a smaller diameter second flange 55 being provided around the threaded connector at the central core of the silencer. Cap 51 includes a first series of holes 57 near the perimeter of the cap and a second series of holes 59 adjacent the central opening of the cap to align with corresponding holes on the two flanges 53 and 55. A series of nuts and bolts, as shown in FIG. 5, secure through the aligned holes in the cap and the flanges on the silencer for securing the cap in position.

As will be clearly seen in FIG. 5 of the drawings, cap 51 can easily be removed to allow access to the packing material 43 contained with the silencer. This is a particularly desirable feature in the event that the packing material needs replacement as may well be the case over the life of the silencer.

Although various preferred embodiments of the present invention have been described in detail, it will be appreciated by those skilled in the art that variations may be made without departing from the spirit of the invention or the scope of the appended claims.

The embodiments of the invention in which an exclusive property or privilege is claimed are defined as follows:

1. An air silencer comprising an air turbulence stage and a noise absorption stage, said air turbulence stage being formed by a tubular screen enclosing a spiral vane wrapping around a central bore extending throughout said air turbulence stage, and a hollow chamber surrounding and only being open through said screen in said air turbulence stage, said noise absorption stage being formed by a hollow tubular screen surrounded by an insulation material packed chamber which only open through said screen in said noise absorption stage, said screens being in air flow communication with one another and with air flow from externally of said silencer.

2. An air silencer as claimed in claim 1, wherein said screens are connected in line with one another by a solid wall tubular connection fitted centrally through a blocking member between the chambers of the stages.

* * * * *